US005477625A

United States Patent [19]

Goldsmith et al.

[11] Patent Number: 5,477,625

[45] Date of Patent: Dec. 26, 1995

[54] INTERCHANGEABLE SHOE

[76] Inventors: Michael A. Goldsmith; Elizabeth A. Goldsmith, both of 75-88 192nd St., Flushing, N.Y. 11366

[21] Appl. No.: 297,148

[22] Filed: Aug. 29, 1994

[51] Int. Cl.[6] ..... A43B 21/36; A43B 3/24; A43B 21/26

[52] U.S. Cl. ..... 36/36 R; 36/100; 36/15; 36/35 R; 36/42; 36/136

[58] Field of Search ..... 36/99, 100, 101, 36/12, 15, 28, 35 R, 36 R, 36 A, 36 B, 36 C, 41, 42, 72 B, 62, 132, 136

[56] References Cited

U.S. PATENT DOCUMENTS

| | | | |
|---|---|---|---|
| 85,748 | 1/1869 | Martin | 36/36 R |
| 272,669 | 2/1883 | Eichelberger | 36/62 |
| 380,507 | 4/1888 | Munger | 36/36 R |
| 1,127,934 | 2/1915 | Smith | 36/36 R |
| 1,437,258 | 11/1922 | Miller | 36/62 |
| 1,537,761 | 5/1925 | Geisman | 36/136 |
| 1,629,916 | 5/1927 | Hirshfield | 36/35 R |
| 1,994,073 | 3/1935 | Christensen | 36/36 R |
| 2,370,889 | 3/1945 | Stout | 36/35 R |
| 3,156,988 | 11/1964 | Rause | 36/62 |
| 4,363,177 | 12/1982 | Boros | 36/42 |
| 5,353,522 | 10/1994 | Wagner | 36/15 |

FOREIGN PATENT DOCUMENTS

| | | | |
|---|---|---|---|
| 2178940 | 2/1987 | United Kingdom | 36/101 |

*Primary Examiner*—Paul T. Sewell
*Assistant Examiner*—Marie Denise Patterson

[57] ABSTRACT

A conversion device for ladies shoes which permits heels and straps to be changed. A heel (2) which is screwed into a heel chamber (8) is secured by a stretch strap (6). Stretch strap (6) is snapped into position at the intersection of a receptor (10) and a connector (15). A screw top (5) is housed in a rubber filler (4). Rubber filler (4) is topped by a protective strip (3) and a leather sole (9).

1 Claim, 1 Drawing Sheet

INTERCHANGEABLE SHOE

BACKGROUND-FIELD OF INVENTION

This invention relates to ladies shoes, specifically to such shoes which allow heels and straps to be changed.

BACKGROUND-DESCRIPTION OF PRIOR ART

At present, there is great demand for a high quantity of shoes to be contained in a women's wardrobe. The constant wear and tear on the heel of the shoe and different occasions (formal and informal) are the culprits. Therefore several inventors created shoes with removal sections.

U.S. Pat. No. 3,608,213 to Jensen (1971), which is "Conversion Heel" allows the wearer of a shoe to be changed readily from a high heel type to a flat wedge type heel and back again. U.S. Pat. No. 5,133,138 utilizes a lock pin to change one heel for another. Finally, U.S. Pat. No. 4,819,344 to Schuller (1989), uses a expandable pin to secure a heel tap to a heel.

U.S. Pat. No. 3,608,213 converts from a high heel to a flat wedge, only allowing for 2 possible changes for the wearer. This invention also makes use of a magnet as a locking device, while a high heel fits into a mold. When the high heel wears down it will no longer fit properly into a flat wedge mold. Also, as magnets encounter friction they will wear out.

Once again there are noticeable structural and functional limitations as U.S. Pat. Nos. 5,133,138 and 4,819,344 are reviewed. U.S. Pat. No. 5,133,138 uses a magnet and a lock pin to secure the heel. The design of this invention puts pressure on the lock pin, breakage is a possibility. U.S. Pat. No. 4,819,344 functions are severally limited. Its only focus is the changing of one heel tap for another.

OBJECTS AND ADVANTAGES

Accordingly, several objects and advantages of my invention are:

(a) to provide a shoe which allows for rapid heel and strap changes;

(b) to provide a shoe with a stretch strap;

(c) to provide a shoe with a stretch strap that only has to be snapped on and off to be replaced;

(d) to provide a shoe with a heel that can easily be replaced by screwing on and off;

(e) to provide a shoe which utilizes a simple, durable, effective and cost efficient instrument as a locking device, a snap on stretch strap;

(f) to provide a shoe with a design that has only three parts (shoe, heel, stretch strap);

(g) to provide a shoe which softens each step by means of a rubber filler in the base of a shoe, Further objects and advantages are to provide a shoe which can be used easily and conveniently for different settings (formal and informal), comfort levels (higher to lower heels) and which makes shoe (color of strap and heel) to attire a much easier process. Still further objects and advantages will become apparent from a consideration of the ensuing description and drawings.

DRAWING FIGURES

FIG. 1 shows a side view of a shoe which has a heel completely screwed and supporting stretch straps snapped on.

REFERENCE NUMERALS IN DRAWINGS

| | |
|---|---|
| 1 shoe | 2 heel |
| 3 protective strip | 4 rubber filler |
| 5 screw top | 6 stretch strap |
| 7 screw core | 8 heel chamber |
| 9 leather sole | 10 receptor |
| 15 connector | 14 rubber heel tap |

DESCRIPTION-FIGS. 1 TO 3

Figure 1:
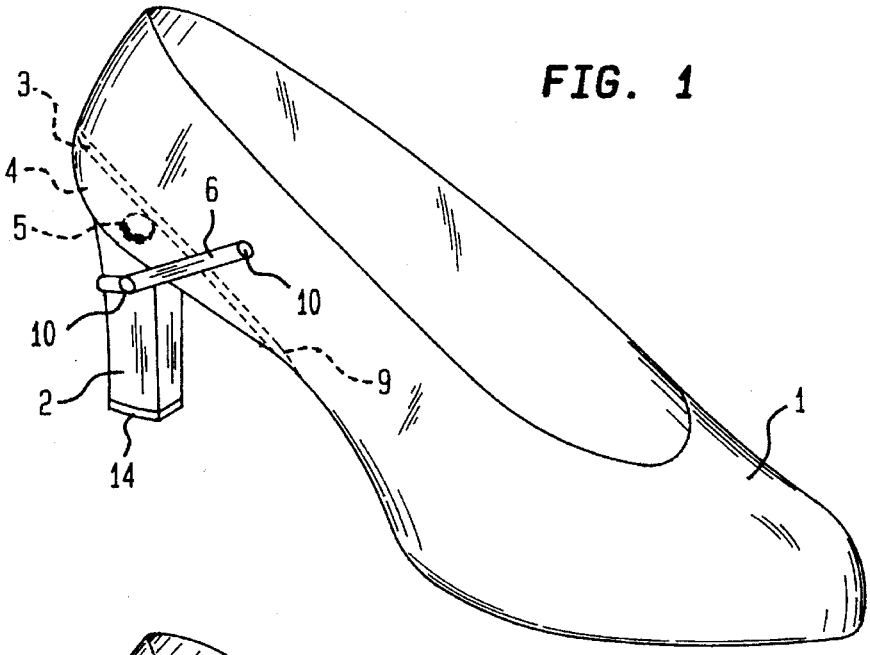

FIG. 1 shows an overall view of a interchangeable shoe. A high heel 2 is connected to a rubber heel tap 14 (by either rubber cement or small nails). The other end of high heel 2 is joined to shoe 1. High heel 2 is connected to shoe 1 at two different points, at a screw top 5 and a receptor 10. Screw top 5 is surrounded by a rubber filler 4. Rubber filler 4 is cemented on its top to a protective strip 3 which is cemented to a shoe. Protective strip 3 (can be a thin piece of metal, hard rubber or plastic) is attached to a leather sole 9. Leather sole 9 is the final layer inside shoe 1.

Figure 2:
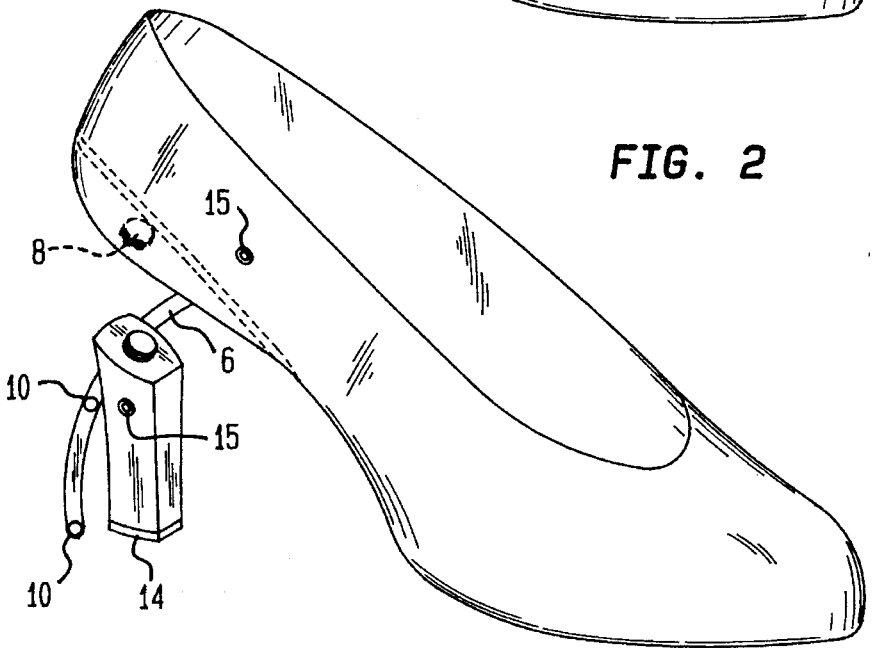
FIG. 2 shows a side view of a shoe which has a heel completely unscrewed and supporting stretch straps unsnapped.
Figure 3:
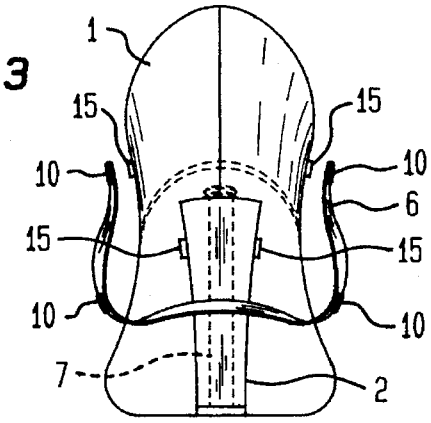
FIG. 3 shows a rear view of a shoe with its connectors/receptors unsnapped and of a screw core of a heel.

FIG. 2 and FIG. 3 show different angles and detail of FIG. 1. In FIG. 2, heel 2 is disconnected from heel chamber 8. Also in FIG. 2, a stretch strap 6 has its receptors 10 unsnapped from its connectors 15. In FIG. 3, a rear view is shown, with heel 2 connected to shoe 1 displaying a screw core 7. Screw core 7 is housed (cemented) inside heel 2. Screw core 7 (made out of hard plastic, metal) is connected to screw top 5 at the top. As in FIG. 2, FIG. 3 receptors 10 are unsnapped from connectors 15.

From the description above, a number of advantages of my interchangeable shoe become evident:

(a) Heel and straps would be able to be changed quickly.

(b) There are only 3 parts.

(c) Replacement parts (heels, stretch straps) could easily be carried in a bag or suitcase to allow on the spot changes.

(d) A stretch strap serves as a safety device (preventing the heel from turning) in addition to a decorative item.

(e) The normal steps of a person are softened by use of a rubber filler.

(f) Heels can be changed from one size to another.

OPERATION-FIGS. 1–3

The manner of using an interchangeable shoe to apply stretch strap 6 and heel 2 would be a two step process. First, one would twist heel 2 clockwise into heel chamber 8. This action would continue until heel 2 could no longer be turned. Secondly, stretch strap 6 would be snapped into position at two points along shoe 1 and two points along heel 2 (four points shown in FIG. 3). The order in which each receptor 10 is snapped into connector 15 is important. One should start from connector 15 on shoe 1 (either from the left or right side) positioning receptor 10 into connector 15, then pulling stretch strap 6 into the next connector 15 on heel 2 (same side as shoe 1). Then one would pull stretch strap 6 into the other connector 15 on heel 2 and finally pulling stretch strap 6 around to position the last receptor 10 into connector 15 (on shoe 1). Once this process has been completed, positioning all four receptors 10 into all four connectors 15, heel 2 is secure.

SUMMARY, RAMIFICATIONS, AND SCOPE

Accordingly, the reader will see that the interchangeable shoe can be used to change heels and straps easily and conveniently. Furthermore, the interchangeable shoe has additional advantages in that

- it provides a stretch strap which serves as a safety device (preventing a heel from turning) in addition to a decorative item;
- it allows one to make changes of heels and stretch straps anyplace;
- it allows ones steps to be softened by use of a rubber filler;
- it allows one to change the size of a heel; and
- it permits one to carry replacement parts.

Although the description above contains many specificities, these should not be construed as limiting the scope of the invention but as merely providing illustrations of some of the presently preferred embodiments of this invention. For example, the rubber filler could be other materials such as sponge or mixture of coils, springs etc; the heels and screw (top/core) could use other materials as wood, hard plastics, rubber, etc.; the strap could use other materials such as spandex, leather, wool, nylon, cotton, etc; the heel shape could other shapes such as square, rectangular, circular etc.

Thus the scope of the invention should be determined by the appended claims and their legal equivalents, rather than by the examples given.

I claim:

1. A shoe comprising:

(a) an upper, (b) a sole affixed to the upper, (c) a replaceable heel, (d) a rubber filler attached to the underside of said sole, (e) means for detachably attaching said replaceable heel with said rubber filler, said means comprising a screw core in said rubber filler and a screw top attached to a top portion of said replaceable heel, (f) a stretch strap with four receptors, (g) said replaceable heel having two connectors and said upper has two connectors, (h) said connectors cooperating with said receptors to connect said stretch strap to said shoe, (i) said strap extending from one side of said upper around a rear portion of said heel and connected to an opposite side of said shoe.

* * * * *

UNITED STATES PATENT AND TRADEMARK OFFICE

CERTIFICATE OF CORRECTION

PATENT NO. : 5,477,625

DATED : December 26, 1995

INVENTOR(S) : Michael A. Goldsmith; Elizabeth A. Goldsmith

It is certified that error appears in the above-indentified patent and that said Letters Patent is hereby corrected as shown below:

On the title page, item [76], change "75-88" to --75-58--.

Signed and Sealed this

Twenty-ninth Day of October 1996

*Attest:*

BRUCE LEHMAN

*Attesting Officer*

*Commissioner of Patents and Trademarks*